US008297378B2

(12) United States Patent
Hall et al.

(10) Patent No.: US 8,297,378 B2
(45) Date of Patent: Oct. 30, 2012

(54) TURBINE DRIVEN HAMMER THAT OSCILLATES AT A CONSTANT FREQUENCY

(75) Inventors: David R. Hall, Provo, UT (US); Scott Dahlgren, Alpine, UT (US); Jonathan Marshall, Provo, UT (US)

(73) Assignee: Schlumberger Technology Corporation, Houston, TX (US)

( * ) Notice: Subject to any disclaimer, the term of this patent is extended or adjusted under 35 U.S.C. 154(b) by 416 days.

(21) Appl. No.: 12/624,207

(22) Filed: Nov. 23, 2009

(65) Prior Publication Data

US 2010/0065334 A1 Mar. 18, 2010

Related U.S. Application Data

(63) Continuation-in-part of application No. 12/415,188, filed on Mar. 31, 2009, now Pat. No. 8,225,883, which is a continuation-in-part of application No. 12/178,467, filed on Jul. 23, 2008, now Pat. No. 7,730,975, which is a continuation-in-part of application No. 12/039,608, filed on Feb. 28, 2008, now Pat. No. 7,762,353, which is a continuation-in-part of application No. 12/037,682, filed on Feb. 26, 2008, now Pat. No. 7,624,824, which is a continuation-in-part of application No. 12/019,782, filed on Jan. 25, 2008, now Pat. No. 7,617,886, which is a continuation-in-part of application No. 11/837,321, filed on Aug. 10, 2007, now Pat. No. 7,559,379, which is a continuation-in-part of application No. 11/750,700, filed on May 18, 2007, now Pat. No. 7,549,489, which is a continuation-in-part of application No. 11/737,034, filed on Apr. 18, 2007, now Pat. No. 7,503,405, which is a continuation-in-part of application No. 11/686,638, filed on Mar. 15, 2007, now Pat. No. 7,424,922, which is a (Continued)

(51) Int. Cl.
*E21B 4/14* (2006.01)

(52) U.S. Cl. ..... 175/107; 175/296; 175/389

(58) Field of Classification Search ..... 175/107, 175/296, 389
See application file for complete search history.

(56) References Cited

U.S. PATENT DOCUMENTS 465,103 A 12/1891 Wegner (Continued)

OTHER PUBLICATIONS

PCT/US07/64544, International Preliminary Report on Patentability, Written Opinion, and International Search Report, Aug. 5, 2008.

(Continued)

*Primary Examiner* — Hoang Dang
(74) *Attorney, Agent, or Firm* — Brinks Hofer Gilson & Lione

(57) ABSTRACT

A hammer assembly comprises a jack element substantially coaxial with an axis of rotation of a drill bit. The jack element includes a distal end extending beyond a working face of the drill bit. A porting mechanism within the bore comprises a first and second disc substantially contacting along a flat interface that is substantially normal to the axis of rotation. The first disc is attached to a turbine which is adapted to rotate the first disc with respect to the second disc. The first disc comprises a first set of ports adapted to align and misalign with a second and third set of ports in the second disc. As the first disc rotates, the sets of ports are adapted to route a drilling fluid into a piston chamber where a porting mechanism causes the jack element to repeatedly extend further beyond the working surface of the drill bit and then retract at a constant frequency.

20 Claims, 9 Drawing Sheets

Related U.S. Application Data continuation-in-part of application No. 11/680,997, filed on Mar. 1, 2007, now Pat. No. 7,419,016, which is a continuation-in-part of application No. 11/673,872, filed on Feb. 12, 2007, now Pat. No. 7,484,576, which is a continuation-in-part of application No. 11/611,310, filed on Dec. 15, 2006, now Pat. No. 7,600,586, said application No. 12/178,467 is a continuation-in-part of application No. 11/278,935, filed on Apr. 6, 2006, now Pat. No. 7,426,968, which is a continuation-in-part of application No. 11/277,394, filed on Mar. 24, 2006, now Pat. No. 7,398,837, which is a continuation-in-part of application No. 11/277,380, filed on Mar. 24, 2006, now Pat. No. 7,337,858, which is a continuation-in-part of application No. 11/306,976, filed on Jan. 18, 2006, now Pat. No. 7,360,610, which is a continuation-in-part of application No. 11/306,307, filed on Dec. 22, 2005, now Pat. No. 7,225,886, which is a continuation-in-part of application No. 11/306,022, filed on Dec. 14, 2005, now Pat. No. 7,198,119, which is a continuation-in-part of application No. 11/164,391, filed on Nov. 21, 2005, now Pat. No. 7,270,196, said application No. 12/178,467 is a continuation-in-part of application No. 11/555,334, filed on Nov. 1, 2006, now Pat. No. 7,419,018.

(56) References Cited

U.S. PATENT DOCUMENTS

| | | | | | |
|---|---|---|---|---|---|
| 616,118 | A | | 12/1898 | Kuhne | |
| 923,513 | A | | 6/1909 | Hardsocg | |
| 946,060 | A | | 1/1910 | Looker | |
| 1,116,154 | A | | 11/1914 | Stowers | |
| 1,183,630 | A | | 5/1916 | Bryson | |
| 1,189,560 | A | | 7/1916 | Gondos | |
| 1,360,908 | A | | 11/1920 | Everson | |
| 1,372,257 | A | | 3/1921 | Swisher | |
| 1,387,733 | A | | 8/1921 | Midgett | |
| 1,460,671 | A | | 7/1923 | Hebsacker | |
| 1,544,757 | A | | 7/1925 | Hufford | |
| 1,619,328 | A | | 3/1927 | Benckenstein | |
| 1,746,455 | A | | 2/1930 | Woodruff et al. | |
| 1,746,456 | A | | 2/1930 | Allington | |
| 1,821,474 | A | | 9/1931 | Mercer | |
| 1,836,638 | A | | 12/1931 | Wright et al. | |
| 1,879,177 | A | | 9/1932 | Gault | |
| 2,022,101 | A | | 11/1935 | Wright | |
| 2,054,255 | A | * | 9/1936 | Howard | 175/298 |
| 2,064,255 | A | | 12/1936 | Garfield | |
| 2,100,692 | A | | 11/1937 | Harmon | |
| 2,169,223 | A | | 8/1939 | Christian | |
| 2,218,130 | A | | 10/1940 | Court | |
| 2,227,233 | A | | 12/1940 | Scott et al. | |
| 2,300,016 | A | | 10/1942 | Scott et al. | |
| 2,320,136 | A | | 5/1943 | Kammerer | |
| 2,345,024 | A | * | 3/1944 | Bannister | 173/31 |
| 2,371,248 | A | | 3/1945 | McNamara | |
| 2,375,335 | A | | 5/1945 | Walker | |
| 2,466,991 | A | | 4/1949 | Kammerer | |
| 2,498,192 | A | | 2/1950 | Wright | |
| 2,540,464 | A | | 2/1951 | Stokes | |
| 2,545,036 | A | | 3/1951 | Kammerer | |
| 2,575,173 | A | | 11/1951 | Johnson | |
| 2,619,325 | A | | 11/1952 | Arutunoff | |
| 2,626,780 | A | | 1/1953 | Ortloff | |
| 2,643,860 | A | | 6/1953 | Koch | |
| 2,725,215 | A | * | 11/1955 | Macneir | 175/298 |
| 2,735,653 | A | | 2/1956 | Bielstein | |
| 2,746,721 | A | | 5/1956 | Moore | |
| 2,755,071 | A | | 7/1956 | Kammerer | |
| 2,776,819 | A | | 1/1957 | Brown | |
| 2,807,443 | A | | 9/1957 | Wyman | |
| 2,819,041 | A | * | 1/1958 | Beckham | 175/93 |
| 2,819,043 | A | | 1/1958 | Henderson | |
| 2,838,284 | A | | 6/1958 | Austin | |
| 2,868,511 | A | | 1/1959 | Barrett | |
| 2,873,093 | A | | 2/1959 | Hildebrandt | |
| 2,877,984 | A | | 3/1959 | Causey | |
| 2,894,722 | A | | 7/1959 | Buttolph | |
| 2,901,223 | A | | 8/1959 | Scott | |
| 2,942,850 | A | | 6/1960 | Heath | |
| 2,942,851 | A | * | 6/1960 | Beck | 175/107 |
| 2,963,102 | A | | 12/1960 | Smith | |
| 2,998,085 | A | | 8/1961 | Dulaney | |
| 3,036,645 | A | | 5/1962 | Rowley | |
| 3,055,443 | A | | 9/1962 | Edwards | |
| 3,058,532 | A | | 10/1962 | Alder | |
| 3,059,708 | A | | 10/1962 | Cannon et al. | |
| 3,075,592 | A | | 1/1963 | Overly et al. | |
| 3,077,936 | A | | 2/1963 | Arutunoff | |
| 3,105,560 | A | | 10/1963 | Zublin | |
| 3,135,341 | A | | 6/1964 | Ritter | |
| 3,139,147 | A | | 6/1964 | Hays et al. | |
| 3,163,243 | A | | 12/1964 | Cleary | |
| 3,199,617 | A | | 8/1965 | White | |
| 3,216,514 | A | | 11/1965 | Nelson | |
| 3,251,424 | A | | 5/1966 | Brooks | |
| 3,294,186 | A | | 12/1966 | Buell | |
| 3,301,339 | A | | 1/1967 | Pennebaker, Jr. | |
| 3,303,899 | A | | 2/1967 | Jones, Jr. et al. | |
| 3,336,988 | A | | 8/1967 | Jones, Jr. | |
| 3,346,060 | A | | 10/1967 | Beyer | |
| 3,379,264 | A | | 4/1968 | Cox | |
| 3,387,673 | A | | 6/1968 | Thompson | |
| 3,429,390 | A | | 2/1969 | Bennett | |
| 3,433,331 | A | | 3/1969 | Heyberger | |
| 3,455,158 | A | | 7/1969 | Richter, Jr. et al. | |
| 3,493,165 | A | | 2/1970 | Schonfeld | |
| 3,583,504 | A | | 6/1971 | Aalund | |
| 3,635,296 | A | | 1/1972 | Lebourg | |
| 3,700,049 | A | | 10/1972 | Tiraspolsky et al. | |
| 3,732,143 | A | | 5/1973 | Joosse | |
| 3,765,493 | A | | 10/1973 | Rosar et al. | |
| 3,807,512 | A | | 4/1974 | Pogonowski et al. | |
| 3,815,692 | A | | 6/1974 | Varley | |
| 3,821,993 | A | | 7/1974 | Kniff | |
| 3,885,638 | A | | 5/1975 | Skidmore | |
| 3,899,033 | A | | 8/1975 | Van Huisen | |
| 3,955,635 | A | | 5/1976 | Skidmore | |
| 3,960,223 | A | | 6/1976 | Kleine | |
| 3,978,931 | A | | 9/1976 | Sudnishnikov et al. | |
| 4,081,042 | A | | 3/1978 | Johnson | |
| 4,096,917 | A | | 6/1978 | Harris | |
| 4,106,577 | A | | 8/1978 | Summers | |
| 4,165,790 | A | | 8/1979 | Emmerich | |
| 4,176,723 | A | | 12/1979 | Arceneaux | |
| 4,253,533 | A | | 3/1981 | Baker | |
| 4,262,758 | A | | 4/1981 | Evans | |
| 4,280,573 | A | | 7/1981 | Sudnishnikov | |
| 4,304,312 | A | | 12/1981 | Larsson | |
| 4,307,786 | A | | 12/1981 | Evans | |
| 4,386,669 | A | | 6/1983 | Evans | |
| 4,397,361 | A | | 8/1983 | Langford | |
| 4,416,339 | A | | 11/1983 | Baker et al. | |
| 4,445,580 | A | | 5/1984 | Sahley | |
| 4,448,269 | A | | 5/1984 | Ishikawa | |
| 4,478,296 | A | | 10/1984 | Richman, Jr. | |
| 4,499,795 | A | | 2/1985 | Radtke | |
| 4,531,592 | A | | 7/1985 | Hayatdavoudi | |
| 4,535,853 | A | | 8/1985 | Ippolito | |
| 4,538,691 | A | | 9/1985 | Dennis | |
| 4,566,545 | A | | 1/1986 | Story | |
| 4,574,895 | A | | 3/1986 | Dolezal | |
| 4,583,592 | A | | 4/1986 | Gazda et al. | |
| 4,592,432 | A | | 6/1986 | Williams et al. | |
| 4,597,454 | A | | 7/1986 | Schoeffler | |
| 4,612,987 | A | | 9/1986 | Cheek | |
| 4,615,399 | A | | 10/1986 | Schoeffler | |
| 4,624,306 | A | | 11/1986 | Traver et al. | |
| 4,637,479 | A | * | 1/1987 | Leising | 175/26 |
| 4,640,374 | A | | 2/1987 | Dennis | |
| 4,679,637 | A | | 7/1987 | Cherrington | |

4,683,781 A 8/1987 Kar et al.
4,732,223 A 3/1988 Schoeffler
4,775,017 A 10/1988 Forrest et al.
4,817,739 A 4/1989 Jeter
4,819,745 A 4/1989 Walter
4,821,819 A 4/1989 Whysong
4,830,122 A 5/1989 Walter
4,836,301 A 6/1989 Van Dongen et al.
4,852,672 A 8/1989 Behrens
4,875,531 A 10/1989 Biehl et al.
4,889,017 A 12/1989 Fuller
4,889,199 A 12/1989 Lee
4,907,665 A 3/1990 Kar et al.
4,962,822 A 10/1990 Pascale
4,974,688 A 12/1990 Helton
4,979,577 A 12/1990 Walter
4,981,184 A 1/1991 Knowlton
4,991,667 A 2/1991 Wilkes et al.
4,991,670 A 2/1991 Fuller
5,009,273 A 4/1991 Grabinski
5,027,914 A 7/1991 Wilson
5,038,873 A 8/1991 Jurgens
5,088,568 A * 2/1992 Simuni ..... 175/14
5,094,304 A 3/1992 Briggs
5,099,927 A 3/1992 Gibson et al.
5,103,919 A 4/1992 Warren et al.
5,119,892 A 6/1992 Clegg
5,135,060 A 8/1992 Ide
5,141,063 A 8/1992 Quesenbury
5,148,875 A 9/1992 Karlsson et al.
5,163,520 A 11/1992 Gibson et al.
5,176,212 A 1/1993 Tandberg
5,186,268 A 2/1993 Clegg
5,222,566 A 6/1993 Taylor
5,255,749 A 10/1993 Bumpurs
5,259,469 A 11/1993 Stjernstrom
5,265,682 A 11/1993 Russell
5,311,953 A 5/1994 Walker
5,314,030 A 5/1994 Peterson et al.
5,361,859 A 11/1994 Tibbitts
5,388,649 A 2/1995 Ilomaki
5,410,303 A 4/1995 Comeau
5,415,030 A 5/1995 Jogi et al.
5,417,292 A 5/1995 Polakoff
5,423,389 A 6/1995 Warren
5,443,128 A 8/1995 Amaudric du Chaffaut
5,475,309 A 12/1995 Hong et al.
5,507,357 A 4/1996 Hult
5,553,678 A 9/1996 Barr et al.
5,560,440 A 10/1996 Tibbitts
5,568,838 A 10/1996 Struthers
5,642,782 A 7/1997 Grimshaw
5,655,614 A 8/1997 Azar
5,678,644 A 10/1997 Fielder
5,720,355 A 2/1998 Lamine et al.
5,732,784 A 3/1998 Nelson
5,758,731 A 6/1998 Zollinger
5,758,732 A 6/1998 Liw
5,778,991 A 7/1998 Runquist et al.
5,794,728 A 8/1998 Palmberg
5,806,611 A 9/1998 Van Den Steen
5,833,021 A 11/1998 Mensa-Wilmot
5,864,058 A 1/1999 Chen
5,896,938 A 4/1999 Money
5,901,113 A 5/1999 Masak
5,901,796 A 5/1999 McDonald
5,904,444 A 5/1999 Kabeuchi et al.
5,924,499 A 7/1999 Birchak et al.
5,947,215 A 9/1999 Lundell
5,950,743 A 9/1999 Cox
5,957,223 A 9/1999 Doster
5,957,225 A 9/1999 Sinor
5,967,247 A 10/1999 Pessier
5,979,571 A 11/1999 Scott et al.
5,992,547 A 11/1999 Caraway
5,992,548 A 11/1999 Silva
6,021,859 A 2/2000 Tibbitts
6,039,131 A 3/2000 Beaton
6,047,239 A 4/2000 Berger et al.
6,050,350 A 4/2000 Morris et al.
6,089,332 A * 7/2000 Barr et al. ..... 175/45
6,092,610 A 7/2000 Kosmala et al.
6,131,675 A * 10/2000 Anderson ..... 175/268
6,150,822 A 11/2000 Hong et al.
6,161,631 A 12/2000 Kennedy
6,186,251 B1 2/2001 Butcher
6,202,761 B1 3/2001 Forney
6,213,225 B1 4/2001 Chen
6,213,226 B1 4/2001 Eppink
6,223,824 B1 5/2001 Moyes
6,269,893 B1 8/2001 Beaton
6,296,069 B1 10/2001 Lamine et al.
6,298,930 B1 10/2001 Sinor
6,321,858 B1 11/2001 Wentworth et al.
6,340,064 B2 1/2002 Fielder
6,363,780 B1 4/2002 Rey-Fabret
6,364,034 B1 4/2002 Schoeffler
6,364,038 B1 4/2002 Driver
6,394,200 B1 5/2002 Watson
6,439,326 B1 8/2002 Huang et al.
6,443,249 B2 9/2002 Beuershausen
6,450,269 B1 9/2002 Wentworth
6,454,030 B1 9/2002 Findley et al.
6,466,513 B1 10/2002 Pabon et al.
6,467,341 B1 10/2002 Boucher et al.
6,474,425 B1 11/2002 Truax
6,484,819 B1 11/2002 Harrison
6,484,825 B2 11/2002 Watson
6,502,650 B1 1/2003 Beccu
6,508,317 B2 1/2003 Eddison et al.
6,510,906 B1 1/2003 Richert
6,513,606 B1 2/2003 Krueger
6,533,050 B2 3/2003 Molloy
6,575,236 B1 6/2003 Heijnen
6,581,699 B1 6/2003 Chen et al.
6,588,518 B2 7/2003 Eddison
6,594,881 B2 7/2003 Tibbitts
6,601,454 B1 8/2003 Botnan
6,601,662 B2 8/2003 Matthias et al.
6,622,803 B2 9/2003 Harvey
6,668,949 B1 12/2003 Rives
6,670,880 B1 12/2003 Hall et al.
6,698,537 B2 3/2004 Pascale
6,729,420 B2 5/2004 Mensa-Wilmot et al.
6,732,817 B2 5/2004 Dewey
6,749,031 B2 6/2004 Klemm
6,789,635 B2 9/2004 Wentworth et al.
6,814,162 B2 11/2004 Moran et al.
6,820,697 B1 11/2004 Churchill
6,822,579 B2 11/2004 Goswami
6,880,648 B2 4/2005 Edscer
6,880,649 B2 4/2005 Edscer
6,913,095 B2 7/2005 Krueger
6,929,076 B2 8/2005 Fanuel et al.
6,948,572 B2 9/2005 Hay et al.
6,953,096 B2 10/2005 Gledhill
6,994,175 B2 2/2006 Egerstrom
7,013,994 B2 3/2006 Eddison
7,025,155 B1 4/2006 Estes
7,073,610 B2 7/2006 Susman
7,096,980 B2 8/2006 Trevas
7,104,344 B2 9/2006 Kriesels et al.
7,198,119 B1 4/2007 Hall et al.
7,204,560 B2 4/2007 Mercier et al.
7,207,398 B2 4/2007 Runia et al.
7,225,886 B1 6/2007 Hall
7,240,744 B1 * 7/2007 Kemick ..... 175/106
7,270,196 B2 9/2007 Hall
7,281,584 B2 10/2007 McGarian et al.
7,328,755 B2 2/2008 Hall et al.
7,337,858 B2 3/2008 Hall et al.
D566,137 S 4/2008 Hall et al.
7,360,610 B2 4/2008 Hall et al.
7,360,612 B2 4/2008 Chen et al.
7,367,397 B2 5/2008 Clemens et al.
D572,735 S 7/2008 Kammerer
7,398,837 B2 7/2008 Hall et al.
7,419,016 B2 9/2008 Hall et al.

| | | | | |
|---|---|---|---|---|
| 7,419,018 | B2 | 9/2008 | Hall | |
| 7,424,922 | B2 | 9/2008 | Hall et al. | |
| 7,426,968 | B2 | 9/2008 | Hall et al. | |
| 7,481,281 | B2 | 1/2009 | Schuaf | |
| 7,484,576 | B2 | 2/2009 | Hall et al. | |
| 7,497,279 | B2 | 3/2009 | Hall et al. | |
| 7,503,405 | B2 * | 3/2009 | Hall et al. | 175/61 |
| 7,506,701 | B2 | 3/2009 | Hall et al. | |
| 7,510,031 | B2 | 3/2009 | Russell et al. | |
| 7,549,489 | B2 | 6/2009 | Hall et al. | |
| 7,559,379 | B2 | 7/2009 | Hall et al. | |
| 7,571,780 | B2 | 8/2009 | Hall et al. | |
| 7,600,586 | B2 | 10/2009 | Hall et al. | |
| 7,617,886 | B2 * | 11/2009 | Hall | 175/51 |
| 7,624,824 | B2 | 12/2009 | Hall et al. | |
| 7,641,003 | B2 | 1/2010 | Hall et al. | |
| 7,694,756 | B2 | 4/2010 | Hall et al. | |
| 2001/0054515 | A1 | 12/2001 | Eddison et al. | |
| 2002/0050359 | A1 | 5/2002 | Eddison | |
| 2003/0213621 | A1 | 11/2003 | Britten | |
| 2004/0154839 | A1 | 8/2004 | McGarian et al. | |
| 2004/0222024 | A1 | 11/2004 | Edscer | |
| 2004/0238221 | A1 | 12/2004 | Runia et al. | |
| 2004/0256155 | A1 | 12/2004 | Kriesels et al. | |
| 2007/0079988 | A1 | 4/2007 | Konschuh et al. | |

OTHER PUBLICATIONS

PCT/US06/43107, International Preliminary Report on Patentability, International Search Report and Written Opinion of the International Searching Authority, Mar. 5, 2007.

PCT/US06/43125, International Preliminary Report on Patentability and Written Opinion of the International Searching Authority, Jun. 4, 2007, and the International Search Report, Feb. 23, 2007.

* cited by examiner

TURBINE DRIVEN HAMMER THAT OSCILLATES AT A CONSTANT FREQUENCY

CROSS REFERENCE TO RELATED APPLICATIONS

This patent application is a continuation-in-part of U.S. patent application Ser. No. 12/415,188 filed on Mar. 31, 2009, which is a continuation-in-part of U.S. patent application Ser. No. 12/178,467 filed on Jul. 23, 2008 and that issued as U.S. Pat. No. 7,730,975 on Jun. 8, 2010, which is a continuation-in-part of U.S. patent application Ser. No. 12/039,608 filed on Feb. 28, 2008 and that issued as U.S. Pat. No. 7,762,353 on Aug. 27, 2010, which is a continuation-in-part of U.S. patent application Ser. No. 12/037,682 filed on Feb. 26, 2008 and that issued as U.S. Pat. No. 7,624,824 on Dec. 1, 2009, which is a continuation-in-part of U.S. patent application Ser. No. 12/019,782 filed on Jan. 25, 2008 and that issued as U.S. Pat. No. 7,617,886 on Nov. 17, 2009, which is a continuation-in-part of U.S. patent application Ser. No. 11/837,321 filed on Aug. 10, 2007 and that issued as U.S. Pat. No. 7,559,379 on Jul. 14, 2009, which is a continuation-in-part of U.S. patent application Ser. No. 11/750,700 filed on May 18, 2007 and that issued as U.S. Pat. No. 7,549,489 on Jun. 23, 2009, which is a continuation-in-part of U.S. patent application Ser. No. 11/737,034 filed on Apr. 18, 2007 and that issued as U.S. Pat. No. 7,503,405 on Mar. 17, 2008, which is a continuation-in-part of U.S. patent application Ser. No. 11/686,638 filed on Mar. 15, 2007 and that issued as U.S. Pat. No. 7,424,922 on Sep. 16, 2008, which is a continuation-in-part of U.S. patent application Ser. No. 11/680,997 filed on Mar. 1, 2007 and that issued as U.S. Pat. No. 7,419,016 on Sep. 2, 2008, which is a continuation-in-part of U.S. patent application Ser. No. 11/673,872 filed on Feb. 12, 2007 and that issued as U.S. Pat. No. 7,484,576 on Feb. 3, 2009, which is a continuation-in-part of U.S. patent application Ser. No. 11/611,310 filed on Dec. 15, 2006 and that issued as U.S. Pat. No. 7,600,586 on Oct. 13, 2009.

U.S. patent application Ser. No. 12/178,467 is also a continuation-in-part of U.S. patent application Ser. No. 11/278,935 filed on Apr. 6, 2006 and that issued as U.S. Pat. No. 7,426,968 on Sep. 23, 2008, which is a continuation-in-part of U.S. patent application Ser. No. 11/277,394 filed on Mar. 24, 2006 and that issued as U.S. Pat. No. 7,398,837 on Jul. 15, 2008, which is a continuation-in-part of U.S. patent application Ser. No. 11/277,380 filed on Mar. 24, 2006 and that issued as U.S. Pat. No. 7,337,858 on Mar. 4, 2008, which is a continuation-in-part of U.S. patent application Ser. No. 11/306,976 filed on Jan. 18, 2006 and that issued as U.S. Pat. No. 7,360,610 on Apr. 22, 2008, which is a continuation-in-part of U.S. patent application Ser. No. 11/306,307 filed Dec. 22, 2005 and that issued as U.S. Pat. No. 7,225,886 on Jun. 5, 2007, which is a continuation-in-part of U.S. patent application Ser. No. 11/306,022 filed on Dec. 14, 2005 and that issued as U.S. Pat. No. 7,198,119 on Apr. 3, 2007, which is a continuation-in-part of U.S. patent application Ser. No. 11/164,391 filed on Nov. 21, 2005 and that issued as U.S. Pat. No. 7,270,196 on Sep. 18, 2007.

U.S. patent application Ser. No. 12/178,467 is also a continuation-in-part of U.S. patent application Ser. No. 11/555,334 filed on Nov. 1, 2006 and that issued as U.S. Pat. No. 7,419,018 on Sep. 2, 2008.

All of these applications are herein incorporated by reference in their entirety.

BACKGROUND OF THE INVENTION

This invention relates to the field of percussive tools used in drilling. More specifically, the invention deals with a downhole jack hammer actuated by drilling fluid.

U.S. Pat. No. 7,073,610 to Susman, which is herein incorporated by reference for all that it contains, discloses a downhole tool for generating a longitudinal mechanical load. In one embodiment, a downhole hammer is disclosed, which is activated by applying a load on the hammer and supplying pressurizing fluid to the hammer The hammer includes a shuttle valve and a piston that are moveable between a first position and a further position. Seal faces of the shuttle valve and the piston are released when the shuttle valve and the piston are in their respective further positions to allow fluid flow through the tool. When the seal is releasing, the piston impacts a remainder of the tool to generate the mechanical load. The mechanical load is cycled by repeated movements of the shuttle valve and the piston.

U.S. Pat. No. 6,994,175 to Egerstrom, which is herein incorporated by reference for all that it contains, discloses a hydraulic drill string device that can be in the form of a percussive hydraulic in-hole drilling machine that has a piston hammer with an axial through hole into which a tube extends. The tube forms a channel for flushing fluid from a spool valve and the tube wall contains channels with ports cooperating with the piston hammer for controlling the valve.

U.S. Pat. No. 4,819,745 to Walter, which is herein incorporated by reference for all that it contains, discloses a device placed in a drill string to provide a pulsating flow of a pressurized drilling fluid to the jets of the drill bit to enhance chip removal and provide a vibrating action in the drill bit itself, providing a more efficient and effective drilling operation.

BRIEF SUMMARY OF THE INVENTION

In one aspect of the present invention, a hammer assembly comprises a jack element substantially coaxial with an axis of rotation of a drill bit. The jack element comprises a distal end that extends beyond a working face of the drill bit. A porting mechanism within a bore of the hammer assembly comprises a first disc and a second disc substantially contacting along a flat interface that is substantially normal to the axis of rotation. The first disc is attached to a turbine that is adapted to rotate the first disc with respect to the second disc. The first disc comprises a set of first ports adapted to align and misalign with a set of second ports and a set of third ports on the second disc. As the first disc rotates, the sets of ports route drilling fluid into a piston chamber adjacent to the second disc, which the jack element to extend further beyond the working surface of the drill bit and then retract at a constant frequency.

The set of first ports and the set of second ports may be aligned, which may route drilling fluid through a first channel to a proximal end of the piston chamber. A piston in the piston chamber may be in mechanical communication with the jack element at a distal end of the piston chamber. In some embodiments, the mechanical communication comprises a rigid mechanical connection, an intermittent mechanical connection, a hydraulic connection, or a combination of these connections. The set of first ports and the set of third ports may also be aligned, which may route drilling fluid through a second channel to the distal end of the piston chamber. The drilling fluid may then direct the piston towards the proximal end of the piston chamber, forcing the drilling fluid in the proximal end of the piston chamber to flow through a set of exhaust ports in the first disc.

The exhaust ports may have a characteristic to absorb energy from redirecting the drilling fluid flow. This characteristic may result from the geometry of the exhaust ports, which may include expanding dimensions from an entrance of the exhaust port to an exit of the exhaust port, an exit of the exhaust port that is not parallel to an entrance of the exhaust port, an exit of the exhaust port proximate an outer perimeter of the first disc, or any combination of these characteristics. This characteristic may resist the turbine's rotation at a non-linear rate with respect to the drilling fluid flow.

In some embodiments, the hammer assembly may comprise a lubrication system. The lubrication system may comprise a shaft that extends from the second disc to a lubricant reservoir adjacent to the turbine. The lubrication system may also comprise a bypass channel that is formed adjacent to the turbine. The bypass channel extends from the lubricant reservoir to beyond a sealing element located adjacent to the first disc. The bypass channel may comprise a set of tortuous paths, which may limit the amount of drilling fluid allowed to flow. The drilling fluid directed to the reservoir may apply a force to direct the lubricant along the shaft while the drilling fluid directed beyond the sealing element may create a pressure balance that limits the amount of lubricant that flows through the sealing element.

In some embodiments, the constant frequency may be achieved through a combination of the turbine and the exhaust ports.

DETAILED DESCRIPTION OF THE INVENTION AND THE PREFERRED EMBODIMENT

Figure 1:
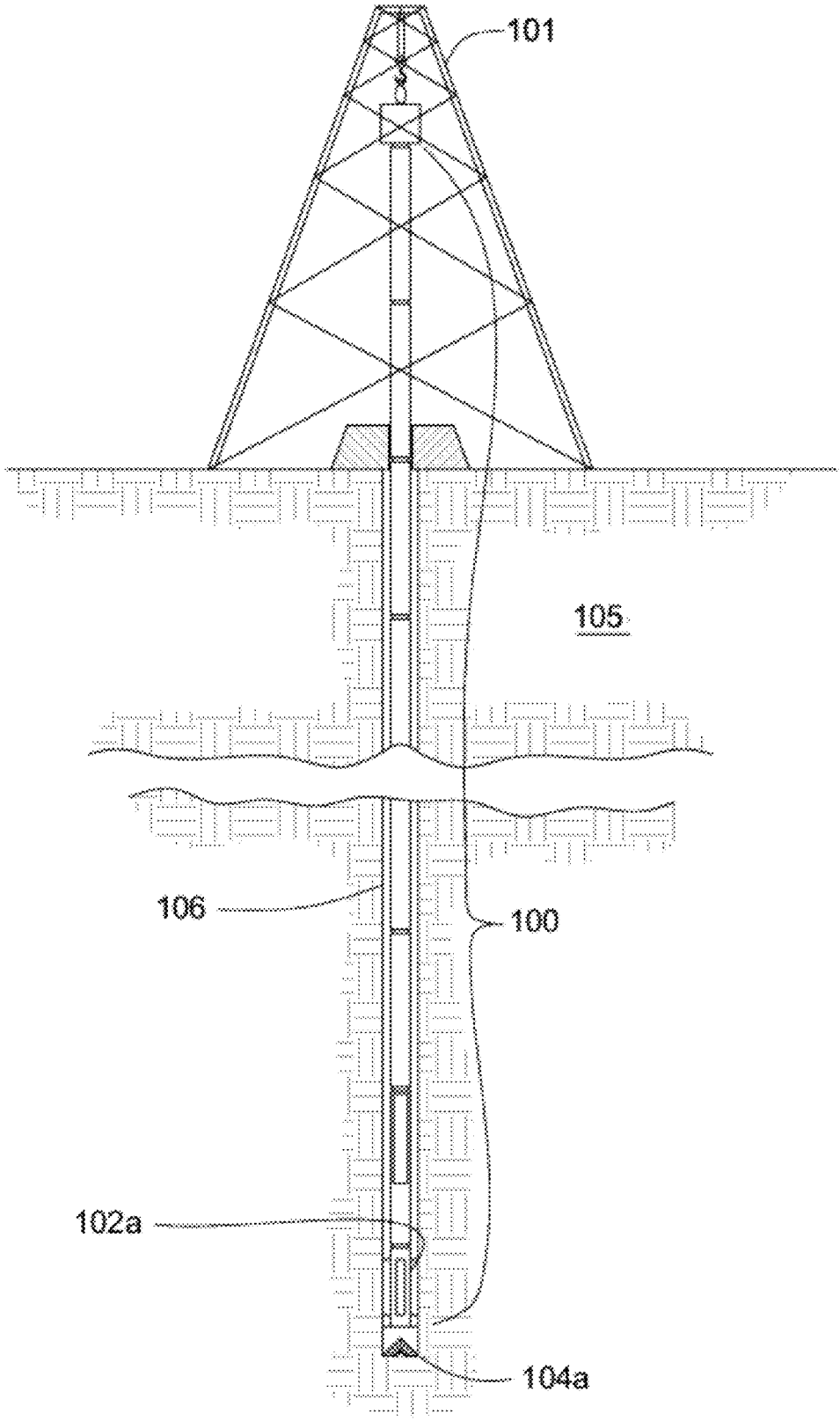
FIG. 1 is a cross-sectional diagram of an embodiment of a down-hole tool string suspended in a bore-hole.

FIG. 1 is a perspective diagram of an embodiment of a tool string 100 suspended by a derrick 101 in a borehole 106. A drilling assembly 102*a* is located at the bottom of the bore hole 106 and comprises a drill bit 104. As the drill bit 104*a* rotates downhole the tool string 100 advances farther into the earth. The drill string 100 may penetrate soft or hard subterranean formations 105.

Figure 2:
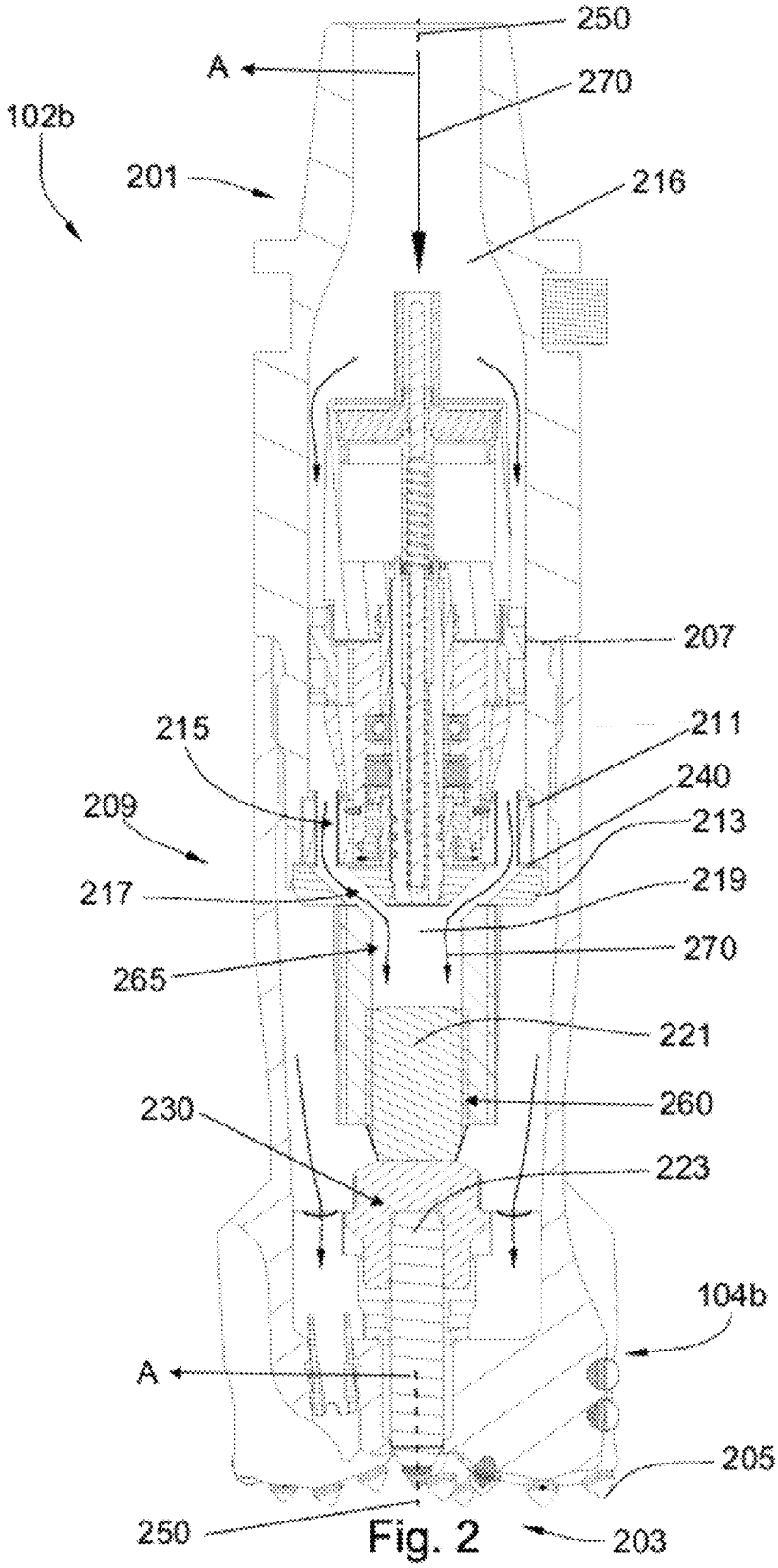
FIG. 2 is a cross-sectional diagram of an embodiment of a drilling assembly.

FIG. 2 is a cross-sectional diagram of an embodiment of a drilling assembly 102*b*. The drilling assembly 102*b* may comprise a drill bit 104*b* having a shank 201 and a working face 203 with a plurality of cutting elements 205 adapted to advance the drill bit 104*b* further into a formation. The drilling assembly 102*b* may comprise at least one turbine 207 disposed within a bore 216 and adapted to interact with a drilling fluid 270.

The drilling assembly 102*b* may further comprise a porting mechanism 209 that directs at least some of the drilling fluid 270 to move a jack element 223. The porting mechanism 209 may comprise a first disc 211 and a second disc 213. The first disc 211 and the second disc 213 may contact along a substantially flat interface 240 that is substantially normal to the drilling assembly's axis of rotation 250. The first disc 211 may be rigidly connected to the turbine 207 so that the first disc 211 rotates as the turbine 207 rotates. A piston chamber 219 may be adjacent to the second disc 213 and may contain a piston 221 capable of transferring energy into the jack element 223, which is located at a distal end 260 of the piston chamber 219. The first disc 211 and the second disc 213 may comprise a set of first ports 215 and a set of second ports 217, which, when aligned, may route drilling fluid 270 into a proximal end 265 of the piston chamber 219. The drilling fluid 270 may apply a force on the piston 221 that causes the piston 221 to move towards the working face 203 of the drill bit 104*b*. The piston 221 may impact against a proximal end 230 of the jack element 223, transferring the kinetic energy of the piston 221 through the jack element 230 and into the formation.

Figure 3:
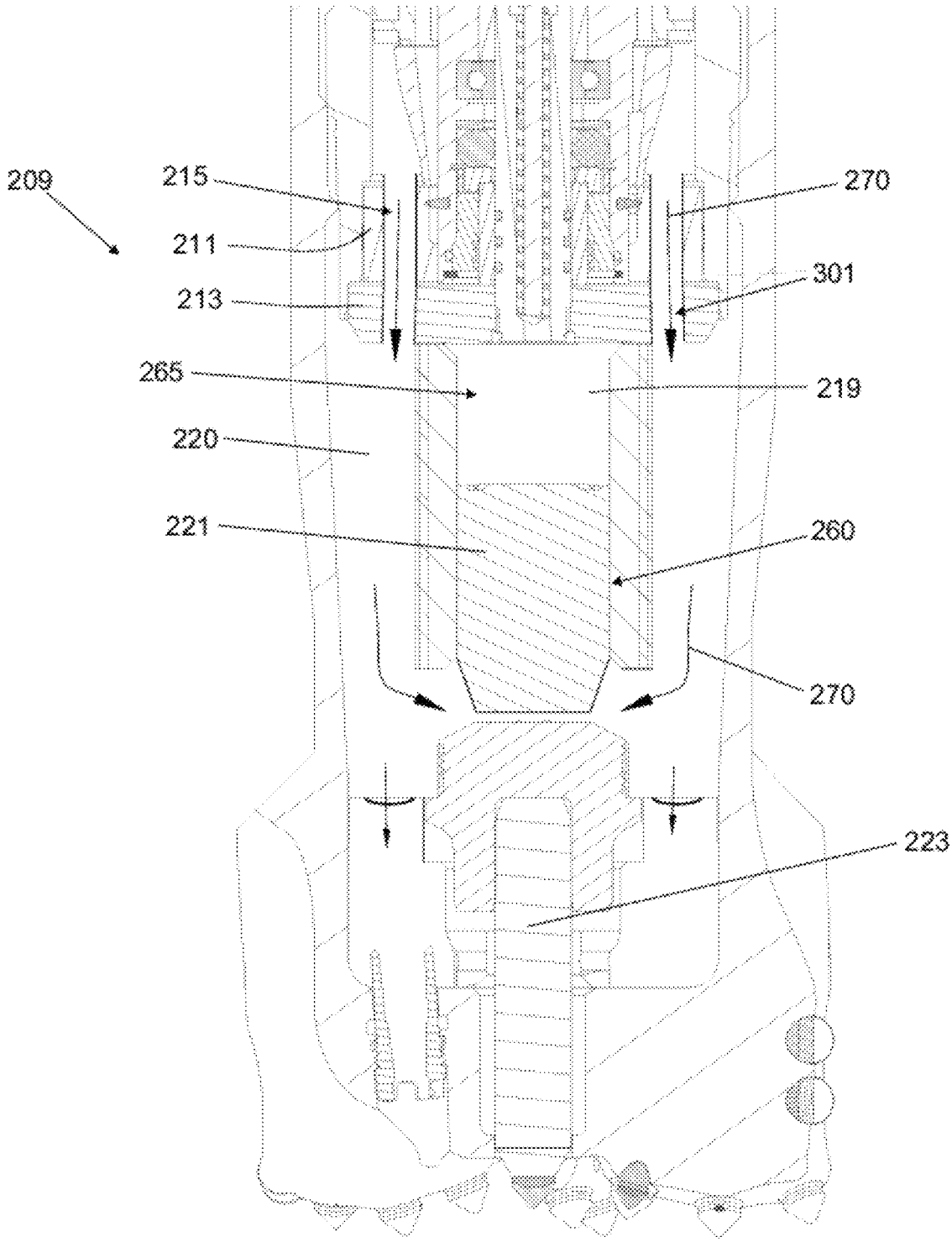
FIG. 3 is a close-up cross-sectional diagram of the embodiment of the drilling assembly in FIG. 2 through section A-A in another configuration.

FIG. 3 discloses the porting mechanism 209 through cross-section A-A of FIG. 2 in which the set of first ports 215 are aligned with a set of third ports 301 in the second disc 213, which may permit drilling fluid 270 to pass through the porting mechanism 209 and a channel 220 to the distal end 260 of the piston chamber 219. This drilling mud 270 may apply a force to the piston 221, pushing the piston 221 back towards the proximal end 265. The movement of the piston 221 toward the proximal end 265 may unload the jack element 223. In some embodiments, the retreat of the piston 221 towards the proximal end 265 may cause a retraction of the jack element 223 away from the formation.

Figure 4:
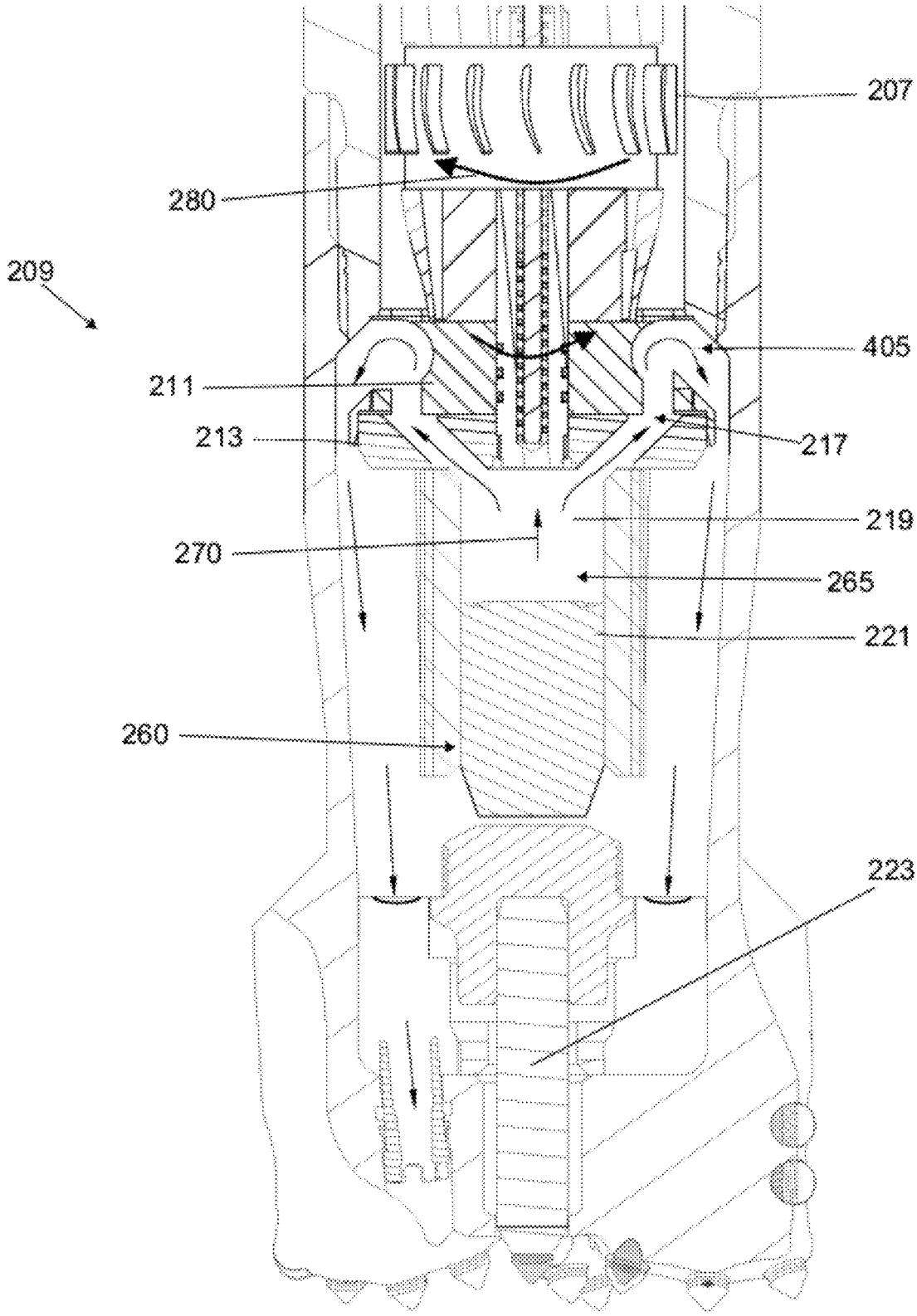
FIG. 4 is a close-up cross-sectional diagram of the embodiment of the drilling assembly in FIG. 2 in yet another configuration.

FIG. 4 discloses the porting mechanism 209 in which the first disc 211 has rotated by 90 degrees. As the drilling fluid 270 flows past the turbine 207, the turbine 270 rotates in a direction 280 and a set of exhaust ports 405 and the set of second ports 217 align. This alignment of the exhaust ports 405 and the set of second ports 217 may cause the drilling fluid 270 in the proximal end 265 of the piston chamber 219 to be forced through the exhaust ports 405. Because of a geometry of the exhaust ports 405, the drilling fluid 270 forced through the exhaust ports 405 may cause a force to resist the rotation of the turbine 207.

The geometry of the exhaust ports 405 may comprise a narrow dimension substantially parallel to the axis of rotation 250 (FIG. 2) and adjacent to the second disc 213. This dimension may expand rapidly with an exit substantially perpendicular to the axis of rotation 250. Energy may be absorbed when the drilling fluid 270 is forced to change direction and exit the exhaust ports 405. The energy in the drilling fluid 270 may be absorbed into the system to resist the rotation of the turbine 207 when the drilling mud 270 is forced to turn sharply.

Figure 5:
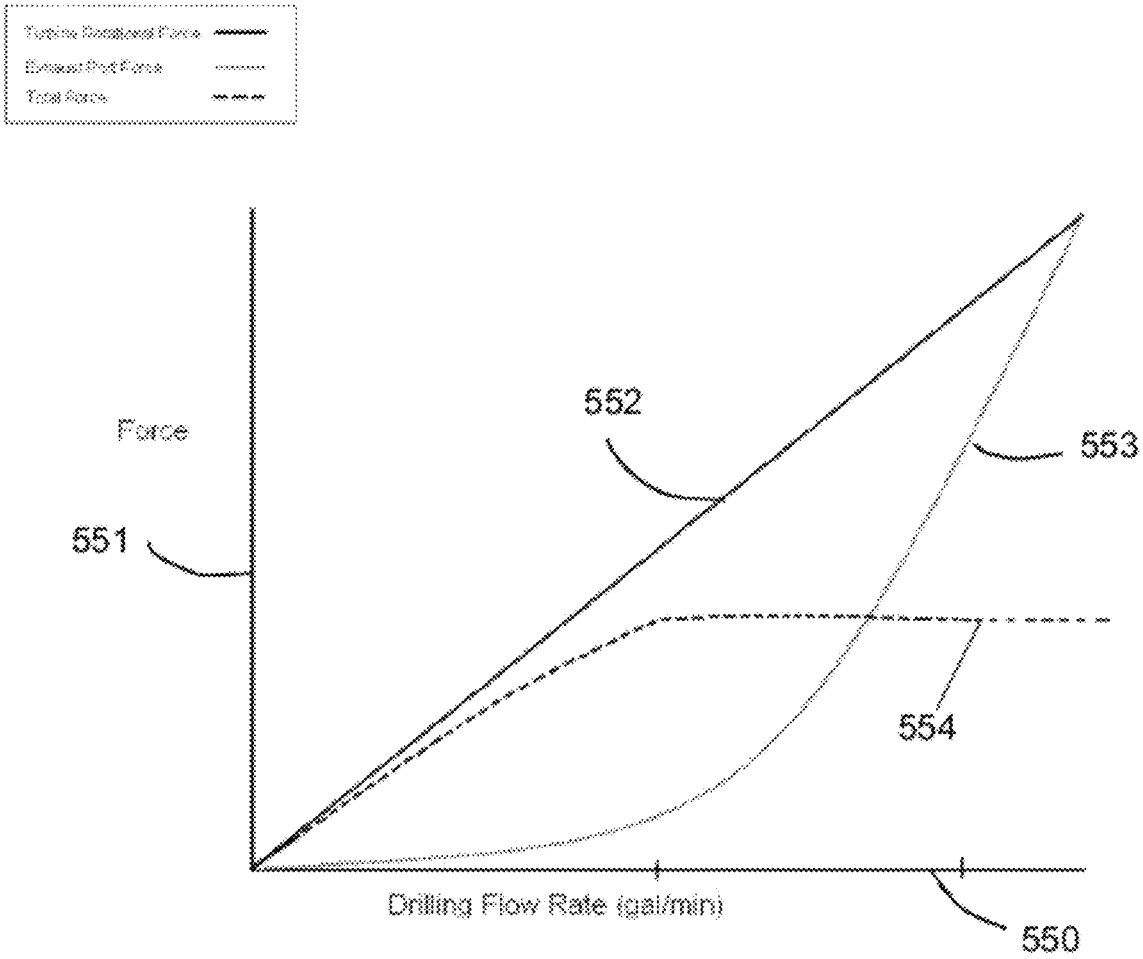
FIG. 5 is a diagram of an embodiment of a relationship between the force of the turbine and the force of the exhaust ports.

FIG. 5 discloses a graph of forces applied by the turbine 207 and the exhaust ports 405 that shows an embodiment of the relationship between the forces exerted by the turbine 207 and the exhaust ports 405. The bottom axis 550 discloses the drilling flow rate in gallons per minute while the side axis 551 discloses the amount of force produced. The black line 552 discloses the rotational force produced by the turbine 207. The gray line 553 discloses the resistive force created by the exhaust ports 405. The dashed line 554 discloses the combination of the turbine force 552 and the exhaust port force 553. As the amount of drilling fluid increases, the turbine 207 has an increase in rotational force against the rotation, but the resistive force from the exhaust ports also increases. To some degree, the resistive force cancels out the proportional turbine force, thus making the total energy into the system more constant. This may cause the turbine 207 rotation to remain constant over a wider range of drilling flow rates.

Figure 6:
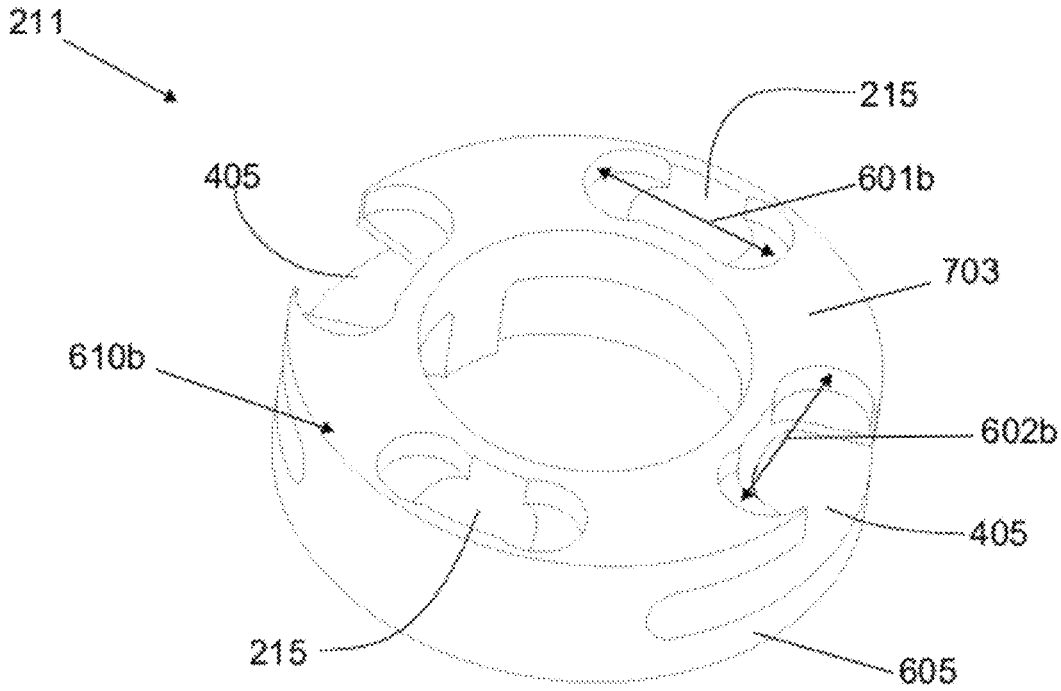
FIG. 6 is a perspective diagram of the bottom of an embodiment of a first disc.
Figure 7:
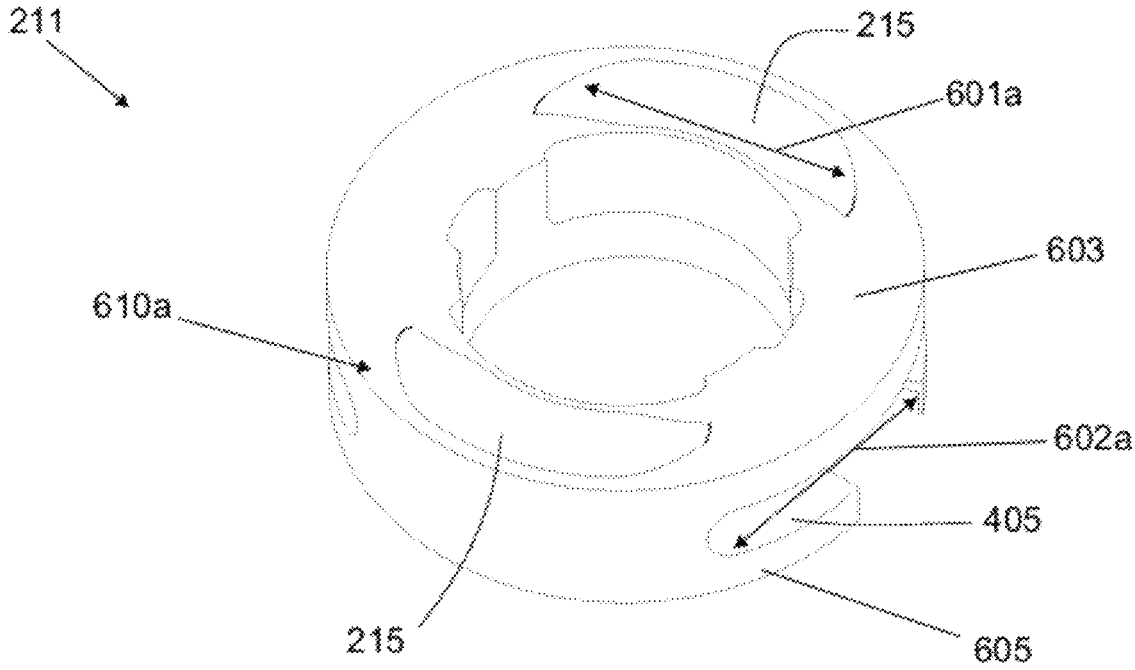
FIG. 7 is a perspective diagram of top of the embodiment of the first disc in FIG. 6.

FIG. 6 is a perspective view of a bottom side 703 of the first disc 211 and FIG. 7 is a perspective view of a top side 603 of the first disc 211. The set of first ports 215 may be spaced evenly proximate an outer perimeter 610*a* on the top side 603 of the first disc 211 and proximate an outer perimeter 610*b* on the bottom side 703 of the first disc 211. The exhaust ports 405 may be also spaced evenly proximate the outer perimeter 610*a* on the top side 603 of the first disc 211 and proximate the outer perimeter 610*b* on the bottom side 703 of the first disc 211 and between the set of first ports 215. The set of first ports 215 may have a wide dimension 601*a* on the top side 603 that may become a significantly narrower dimension 601*b* on the bottom side 703. The exhaust ports 415 may have a narrow dimension 602*b* on the bottom side 703 that expands to a much wider dimension 602*a* with an exit on an outer edge 605 of the first disc 211.

Figure 8:
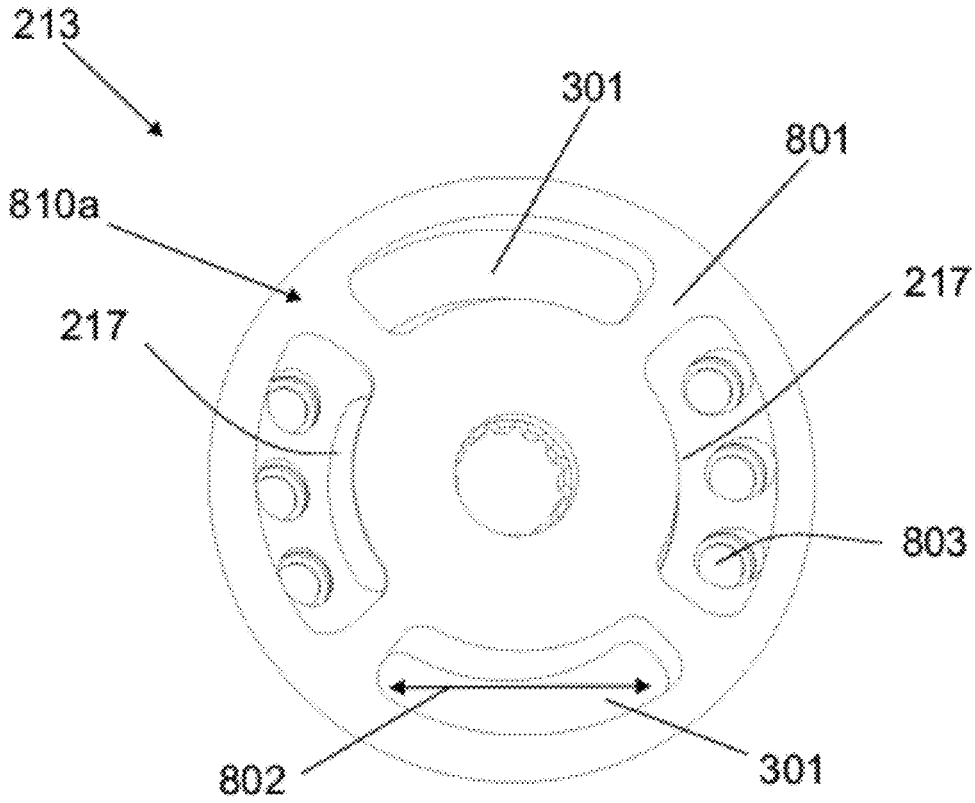
FIG. 8 is a perspective diagram of the top of an embodiment of a second disc.
Figure 9:
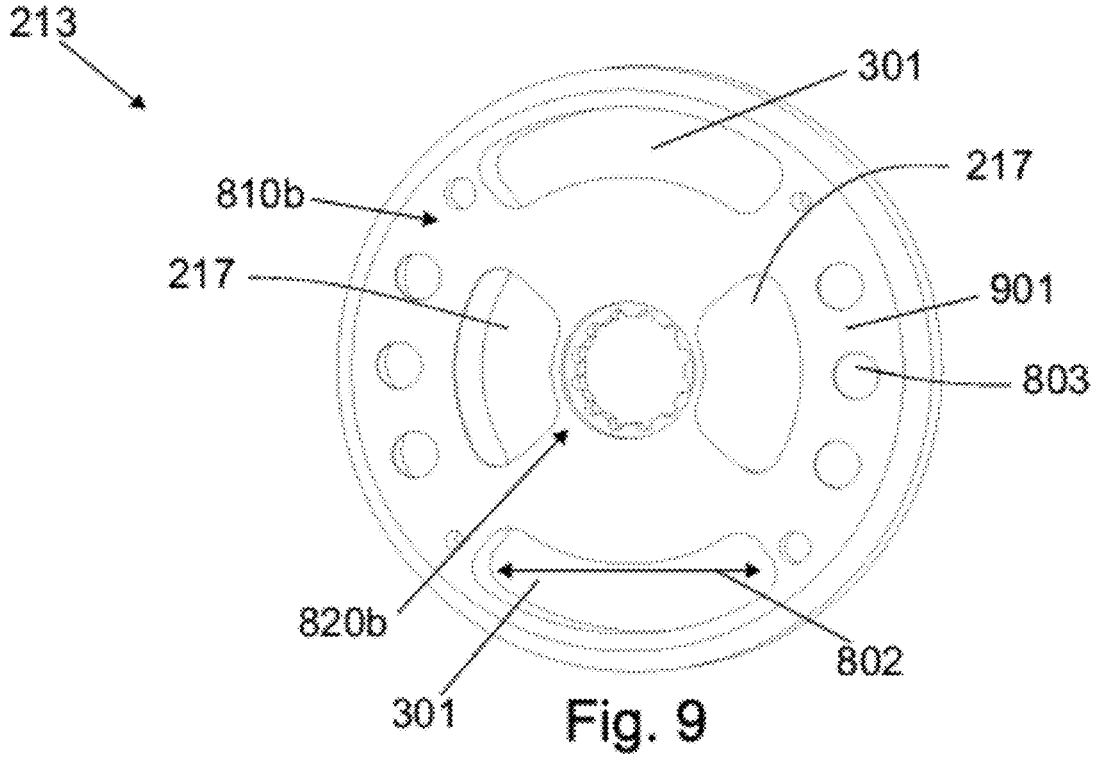
FIG. 9 is a perspective diagram of the bottom of the embodiment of the second disc in FIG. 8.

FIG. 8 is a perspective view of the top side 801 of the second disc 213 and FIG. 9 is a perspective view of a bottom side 901 of the second disc 213. The set of second ports 217 may be spaced evenly proximate an outer perimeter 810*a* on the top side 801 of the second disc 213 and proximate an inner perimeter 820*b* on the bottom side 901 of the second disc 213, with the set of third ports 301 proximate the outer perimeter 810 *a*, 810*b* and spaced evenly between the set of second ports 217. The set of second ports 217 may comprise nozzles 803 that may allow drilling fluid to flow to the working face 203 of the drill bit 104*b*, allowing the drilling fluid to effectively bypass the piston chamber 219 as illustrated in FIG. 3. If the piston chamber 219 were to fail, the nozzles 803 may provide an outlet for the drilling fluid so as to prevent a pressure build-up and possible harm to the drilling assembly. The set of second ports 217 may be angled to facilitate the flow of drilling fluid into the piston chamber 219 as illustrated in FIG. 2. The set of ports third 301 may comprise a large dimension 802 completely through the second disc 213.

Figure 10:
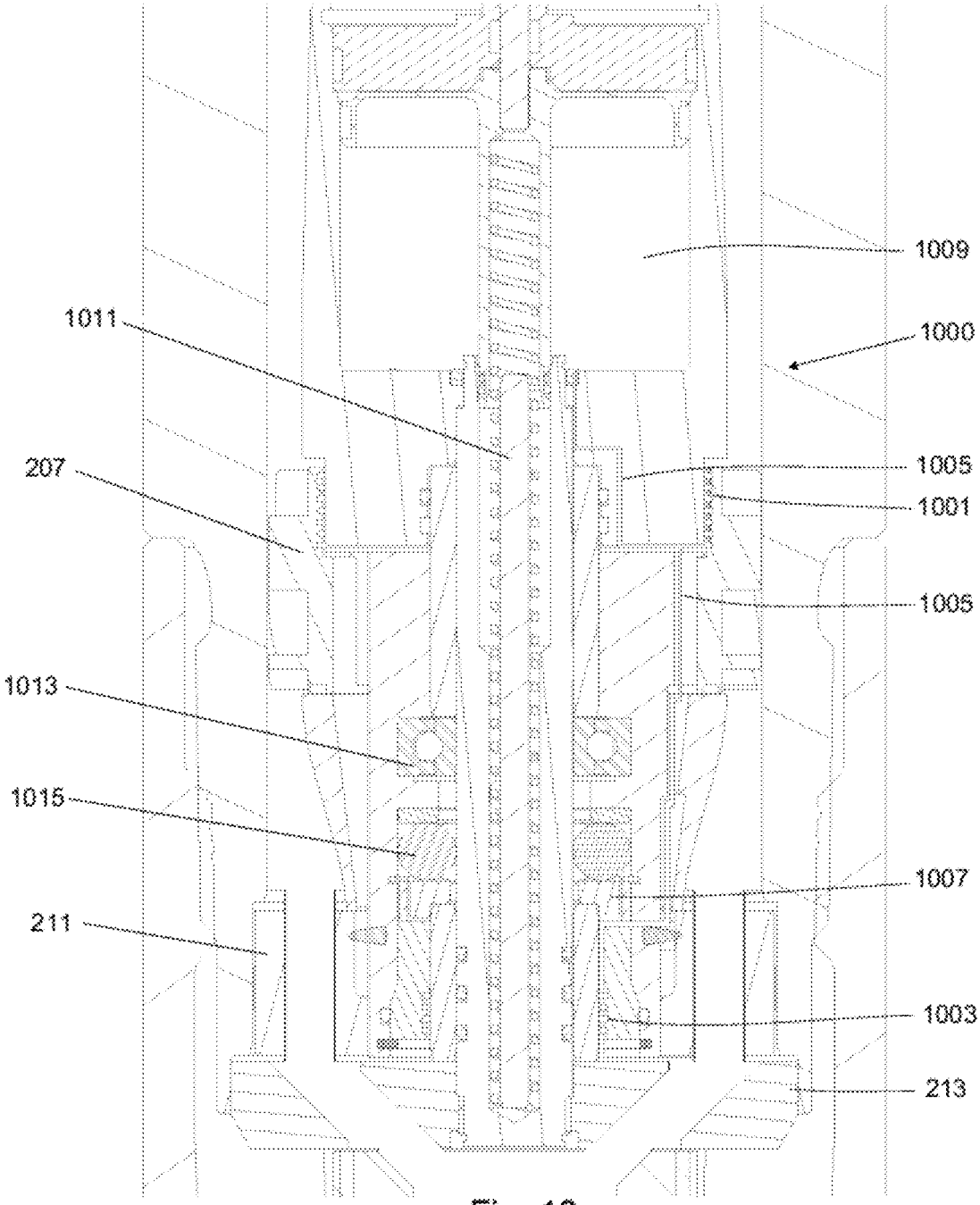
FIG. 10 is a close-up cross-sectional diagram of an embodiment of a lubrication system in the embodiment of the drilling assembly in FIG. 2.

FIG. 10 is a cross-sectional diagram of a lubrication system 1000 of the drilling assembly 102*b*. The lubrication system 1000 may have a set of first tortuous paths 1001 adjacent to the turbine 207 and a set of second tortuous paths 1003 adjacent to the first disc 211. The lubrication system 1000 may also have a bypass channel 1005 in communication with a lubrication reservoir 1009 and bypasses sealing elements 1007 of the lubrication system 1000. The drilling fluid passing into the lubrication reservoir 1009 may push lubricant along a shaft 1011 that extends to a first bearing 1013 and a second bearing 1015. The first bearing 1013 may comprise a thrust bearing and the second bearing 1015 may comprise a ball bearing. The first bearing 1013 and the second bearing 1015 may help support radial and axial loads as well as reducing rotational friction. The drilling fluid passing to beyond the sealing element 1007 creates a pressure balance which regulates the amount of lubrication that exits the shaft 1011. The regulation of lubrication may keep the first bearing 1013 and the second bearing 1015 well lubricated over an extended period of time, which may increase the amount of time that can pass before the lubrication reservoir 1009 needs to be refilled.

Figure 11:
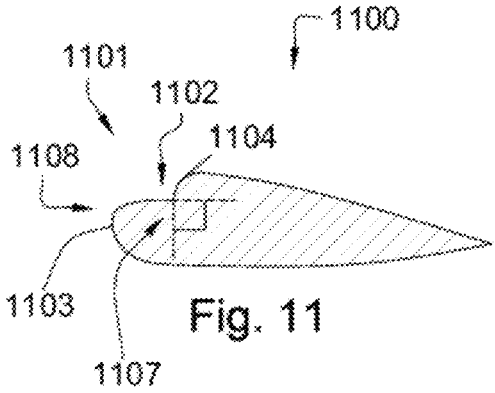
FIG. 11 is a cross-sectional diagram of an embodiment of a turbine blade.

FIG. 11 discloses a cross-section of a turbine blade 1100 which may be used in the present invention. The turbine 207 may also comprise an overall characteristic which causes the turbine 207 to stall when a rotor of the turbine 207 exceeds a maximum rotational velocity. The turbine blade 1100 may comprise a trip 1101 that may be adapted to cause the turbine blade 1100 to stall at a predetermined velocity. The trip 1101 may comprise a concavity 1102 formed in a leading portion 1108 of the turbine blade 1100. The concavity 1102 may separate a first camber 1103 and a second upper camber 1104 of the leading portion 1108 of the turbine blade 1100. The first camber 1103 and the second upper camber 1104 may comprise substantially equivalent curvatures. The concavity 1102 may also comprise an acute transition 1107 from the first camber 1103 to the second upper camber 1104. The acute transition 1107 may form an angle of at least 75 degrees.

Figure 12:
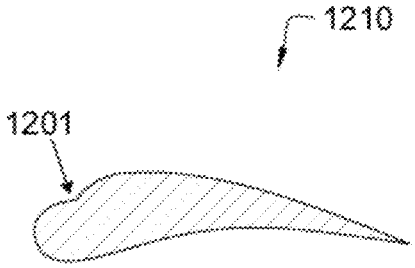
FIG. 12 is a cross-sectional diagram of another embodiment of a turbine blade.

FIG. 12 discloses a spiral turbine blade section 1210 that may also be used with the present invention, also comprises a stalling trip 1201.

Figure 13:
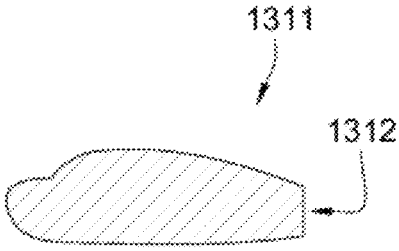
FIG. 13 is a cross-sectional diagram of another embodiment of a turbine blade.

FIG. 13 discloses a straight turbine blade section 1311 that also comprises a truncated trailing portion 1312.

Figure 14:
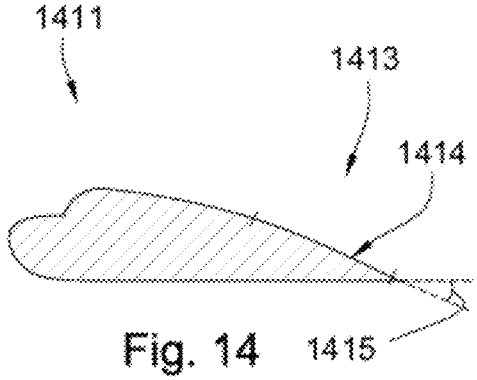
FIG. 14 is a cross-sectional diagram of another embodiment of a turbine blade.

FIG. 14 discloses a turbine blade section 1411 with a trailing portion 1413 comprising a profile segment 1414 that forms an angle 1415 greater than 25 degrees.

Figure 15:
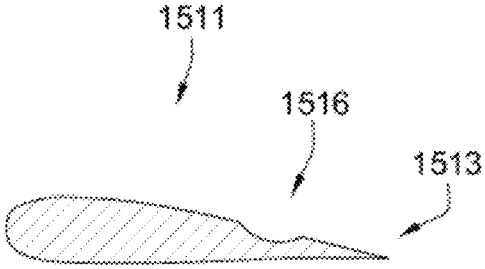
FIG. 15 is a cross-sectional diagram of another embodiment of a turbine blade.

FIG. 15 discloses a turbine blade section 1511 with a trailing portion 1513 also comprising a concavity 1516.

Whereas the present invention has been described in particular relation to the drawings attached hereto, it should be understood that other and further modifications apart from those shown or suggested herein, may be made within the scope and spirit of the present invention.

The invention claimed is:

1. A drilling assembly, comprising:

a drill bit having an axis of rotation, said drill bit including:

a shank;

a working face spaced apart from said shank;

a bore extending between said shank and said working face, said bore configured to receive a drilling fluid; and, a jack element substantially coaxial with said axis of rotation, said jack element including a distal end extending beyond said working face;

a turbine disposed within said bore and configured to rotate under an influence of said drilling fluid;

a porting mechanism disposed within said bore, said porting mechanism including:

a piston chamber having a proximal end and a distal end, said piston chamber including a piston in communication with said jack element;

a first disc coupled to and configured to rotate with said turbine, said first disc including at least one first port; and, a second disc, said second disc including at least one second port and at least one third port, said first disc substantially contacting said second disc along a flat interface substantially normal to said axis of rotation, said first port aligning and misaligning with said second port and said third port as said first disc rotates relative to said second disc, thereby allowing said drilling fluid to pass into and out of said piston chamber to extend said jack element beyond said working face and to retract said jack element at a constant frequency.

2. The drilling assembly of claim 1, wherein said first port aligns with said second port to pass said drilling fluid into said proximal end of said piston chamber.

3. The drilling assembly of claim 2, wherein said piston is in mechanical communication with said jack element at said distal end of said piston chamber.

4. The drilling assembly of claim 3, wherein said mechanical communication is at least one of a rigid mechanical connection and an intermittent mechanical connection.

5. The drilling assembly of claim 1, wherein said first port aligns with said third port to pass said drilling fluid towards said distal end of said piston chamber.

6. The drilling assembly of claim 5, wherein said drilling fluid directs said piston towards said proximal end of said piston chamber.

7. The drilling assembly of claim 2, wherein said first disc further comprises at least one exhaust port, said exhaust port aligning and misaligning with said second port as said first disc rotates relative to said second disc, thereby allowing said drilling to pass out of said proximal end of said piston chamber.

8. The drilling assembly of claim 7, wherein said exhaust port has a characteristic of absorbing energy from said drilling fluid as said exhaust port redirects said drilling fluid.

9. The drilling assembly of claim 8, wherein said characteristic is dependent on a geometry of said exhaust port, said geometry including at least one of a first dimension of said exhaust port and a second dimension of said exhaust port larger than said first dimension, an exit of said exhaust port that is not parallel to an entrance said exhaust port, and an exit of said exhaust port on an outer edge of said first disc.

10. The drilling assembly of claim 8, wherein said characteristic causes a resistance that increases at a non-linear rate as a flow rate of said drilling fluid increases.

11. The drilling assembly of claim 7, wherein said constant frequency is a function of at least one of a ratio between an impact energy of said jack element and a wear on said jack element, a geometry of at least one blade of said turbine, and a geometry of said exhaust port.

12. The drilling assembly of claim 1, wherein said second port comprises a flow area smaller than a flow area of said first port.

13. The drilling assembly of claim 1, wherein said drilling assembly further comprises a lubrication system.

14. The drilling assembly of claim 13, wherein said lubrication system comprises a shaft that extends from said second disc to a lubricant reservoir.

15. The drilling assembly of claim 14, wherein said lubrication system includes a bypass channel that extends from said lubricant reservoir to beyond a sealing element.

16. The drilling assembly of claim 15, wherein said bypass channel includes a tortuous path.

17. The drilling assembly of claim 16, wherein said drilling fluid passes into said lubricant reservoir applies and pushes a lubricant along said shaft.

18. The drilling assembly of claim 16, wherein said drilling fluid passes into said bypass channel and beyond said sealing element, thereby creating a pressure balance within said lubrication system that limits an amount of a lubricant that exits said shaft.

19. A drilling assembly, comprising:

a drill bit, said drill bit including:

a shank;

a working face spaced apart from said shank;

a bore extending between said shank and said working face, said bore configured to receive a drilling fluid; and, a jack element, said jack element including a distal end extending beyond said working face;

a turbine disposed within said bore and configured to rotate under an influence of said drilling fluid;

a porting mechanism disposed within said bore, said porting mechanism including:

a piston chamber, said piston chamber including a piston in contact with said jack element;

a first disc coupled to and configured to rotate with said turbine, said first disc including at least one first port and at least one exhaust port; and, a second disc, said second disc including at least one second port and at least one third port, said first port and said exhaust port alternately aligning and misaligning with said second port and said third port as said first disc rotates relative to said second disc, thereby allowing said drilling fluid to pass into and out of said piston chamber to extend said jack element beyond said working face and to retract said jack element.

20. A drilling assembly, comprising:

a shank;

a working face spaced apart from said shank;

a bore extending between said shank and said working face, said bore configured to receive a drilling fluid; and, a jack element substantially coaxial with said axis of rotation, said jack element including a distal end extending beyond said working face;

a turbine disposed within said bore and configured to rotate under an influence of said drilling fluid;

a porting mechanism disposed within said bore, said porting mechanism including:

a piston chamber, said piston chamber including a piston in contact with said jack element;

a first disc coupled to and configured to rotate with said turbine, said first disc including a set of first ports; and, a second disc, said second disc including a set of second ports and a set of third ports, said set of first ports aligning and misaligning with said set of second ports and said set of third ports as said first disc rotates relative to said second disc, thereby allowing said drilling fluid to pass into and out of said piston chamber to cyclically extend said jack element beyond said working face and to retract said jack element.

* * * * *